United States Patent [19]

Vidondo

[11] Patent Number: 5,056,645

[45] Date of Patent: Oct. 15, 1991

[54] COIN OPERATED TELEPHONE PAYMENT DEVICE

[75] Inventor: Felix G. Vidondo, Peralta, Spain

[73] Assignee: Jofemar, S.A., Peralta, Spain

[21] Appl. No.: 570,866

[22] Filed: Aug. 21, 1990

Related U.S. Application Data

[63] Continuation-in-part of Ser. No. 358,719, May 26, 1989, abandoned.

[30] Foreign Application Priority Data

May 31, 1988 [ES] Spain ..... 8801709

[51] Int. Cl.[5] ..... G07F 9/04

[52] U.S. Cl. ..... 194/346; 221/82; 453/20; 453/29; 453/40; 453/49

[58] Field of Search ..... 194/346, 351; 453/19, 453/29, 32, 33, 34, 35, 39, 40, 49, 57, 20; 221/76, 82, 83, 86, 87, 89, 90, 91, 265

[56] References Cited

U.S. PATENT DOCUMENTS

| | | | |
|---|---|---|---|
| 2,251,755 | 8/1941 | Peters | 453/57 X |
| 3,415,256 | 12/1968 | Meloni | 453/40 X |
| 4,836,825 | 6/1989 | Smeets et al. | 453/40 X |
| 4,946,418 | 8/1990 | DeFeo | 453/40 X |

FOREIGN PATENT DOCUMENTS

| | | | |
|---|---|---|---|
| 0143972 | 6/1985 | European Pat. Off. | 453/49 |
| 3507140 | 8/1986 | Fed. Rep. of Germany | 194/346 |
| 3512579 | 10/1986 | Fed. Rep. of Germany | 194/346 |
| 3541869 | 6/1987 | Fed. Rep. of Germany | 453/49 |
| 0600453 | 6/1978 | Switzerland | 453/49 |
| 2070307 | 9/1981 | United Kingdom | 194/346 |
| 8001117 | 5/1980 | World Int. Prop. O. | 453/49 |

*Primary Examiner*—F. J. Bartuska

*Attorney, Agent, or Firm*—Zarley, McKee, Thomte, Voorhees & Sease

[57] ABSTRACT

A coin operated telephone payment device is provided for use in public telephones. The device includes a provisional receptacle (7) for the coins (12) inserted, formed by a cylindrical body provided with a series of open radial compartments (11) blocked at the bottom by a body (9) provided with an inclination towards the outside. The body is capable of turning slightly so as to allow the coins located in the compartments to pass to the return box (8). The compartments have an operable payment door (6) so that the coin to be paid goes to the definitive coin box (4).

1 Claim, 2 Drawing Sheets

COIN OPERATED TELEPHONE PAYMENT DEVICE

This is a Continuation-in-Part application generated from Ser. No. 358,719 filed May 26, 1989, now abandoned.

BACKGROUND OF THE INVENTION

The following invention as is expressed in the title of the present specification consists of coin operated telephone payment device, which has noteworthy advantages with regard to those conventionally used.

In order to make telephone calls from those conventional public telephones which operate by inserting coins, the coins can be put into an outside slot on the telephone. Upon talking, the coins pass into the money box, without the possibility of recovery by the user. In other words, payment is made prior to the conversation.

Thus, when the time corresponding to the value of the inserted coin is used up, another coin must be inserted or the call will be cut off.

This form of payment has the inconvenience for the user of public telephones that if a coin with a large value (for example 200 ptas.) is inserted and the person with whom one wishes to speak is not in and the time of the call corresponds to a much smaller value (for example 20 ptas.) the difference is not recovered.

Likewise, in other public telephones, when the user wishes to make a call, he inserts the coins which are selected and the valid ones are deposited by order of introduction in a provisional receptacle, from which they pass to a definitive receptacle as the conversation goes on. Once the conversation is over and the caller hangs up, the coins which have not been used are returned to the return box. In this case, the user has the same inconvenience cited above, since the coins go to the definitive coin box by order of introduction and value, with the cost of the call not corresponding to the time used.

In order to overcome this inconvenience and so that the cost of the call corresponds as much as possible to the coins that the user has inserted, the device of the present invention correlates the cost of the call to the coins inserted.

SUMMARY OF THE INVENTION

The device is made up of a provisional receptacle for receiving the inserted coins, which is located below a conventional coin value selector. The provisional receptacle is formed by a cylindrical body furnished with a series of radial compartments, each adapted to receive a single coin in a vertical position. The bottom of the compartments are open, and may be closed by means of a body connected to it and which upon turning slightly, frees all the coins that remain in the compartments.

The user can insert as many coins as compartments the provisional receptacle has for them. The coins may be of the same or of a different value. Hence, when the user is speaking at the moment when the amount coincides with the coin of the highest value of those inserted, the coin will go into the definitive receptacle, and so on with the rest of the coins.

If on the contrary, the user has finished speaking and nothing has been paid, as the amount has not reached that of the coin of the highest value in the provisional receptacle, a combination of the coins existing in the provisional receptacle will be effected for payment of the amount which is closest to the cost of the call. Once the cost of the call has been paid, the body backed to the provisional receptacle which acts as the closure thereof and coin support will turn slightly with a single thrust to free all the coins that remain in the provisional receptacle, with the coins going to the return box.

BRIEF DESCRIPTION OF THE DRAWINGS

In order to complement the description which is going to be made hereinafter and for the purpose of furnishing a better understanding of its features, a drawing in whose figures the following is represented accompanies the present specification.

DETAILED DESCRIPTION OF THE DRAWINGS

Figure 1:
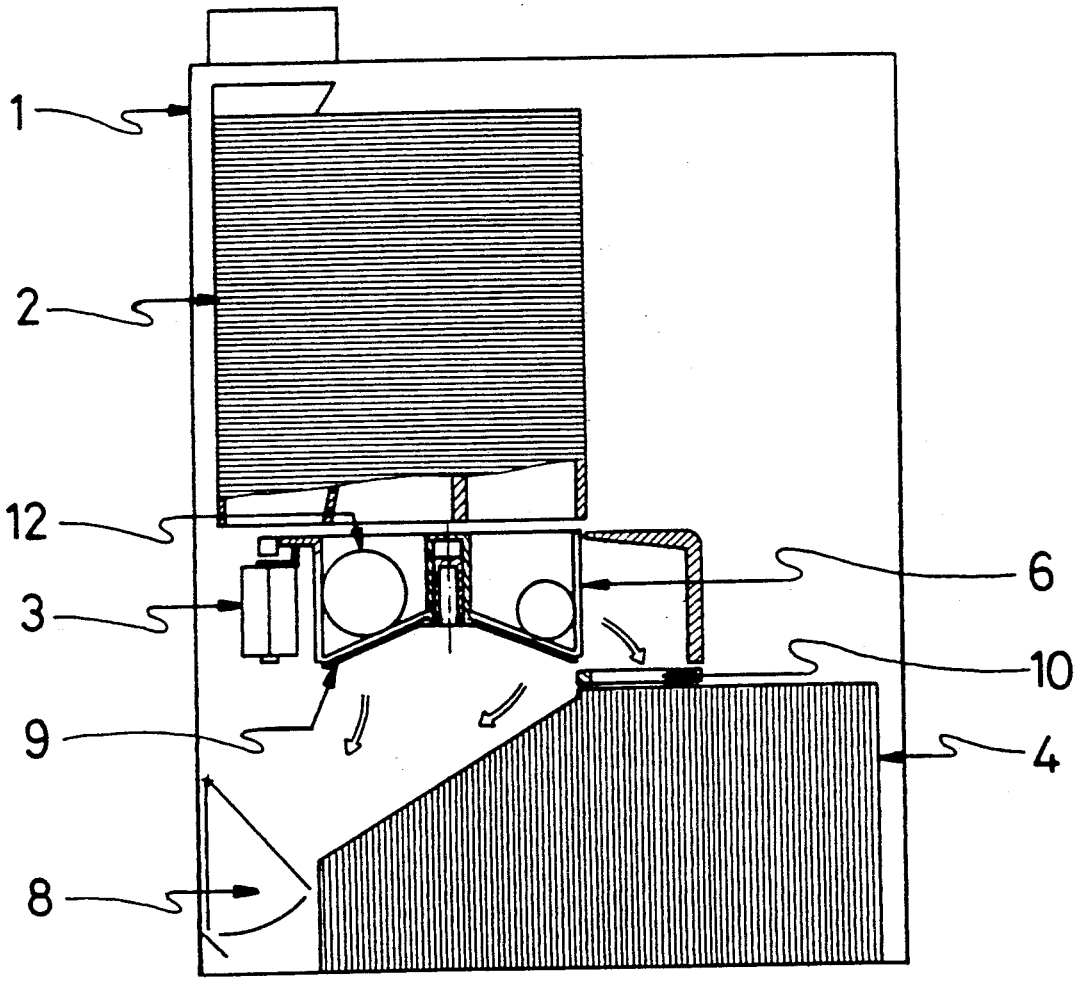
FIG. 1 shows a sectional elevational view of the telephone apparatus with the selector and exact payment device of the present invention.
Figure 2:
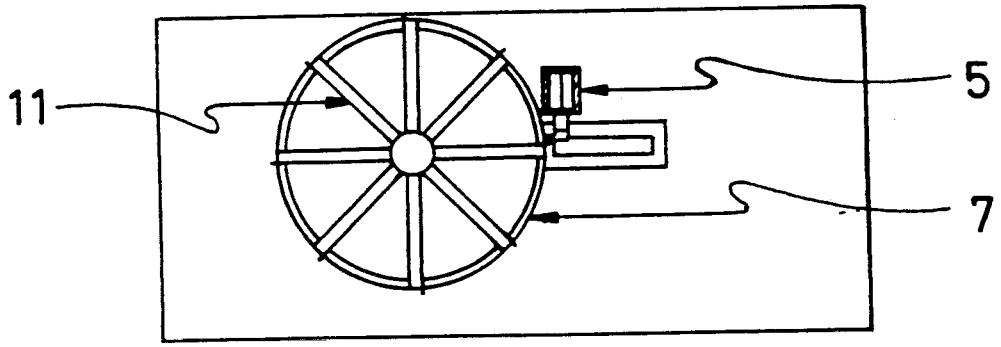
FIG. 2 shows a detailed plan view of the exact payment device, including the provisional receptacle with its compartments.
Figure 3:
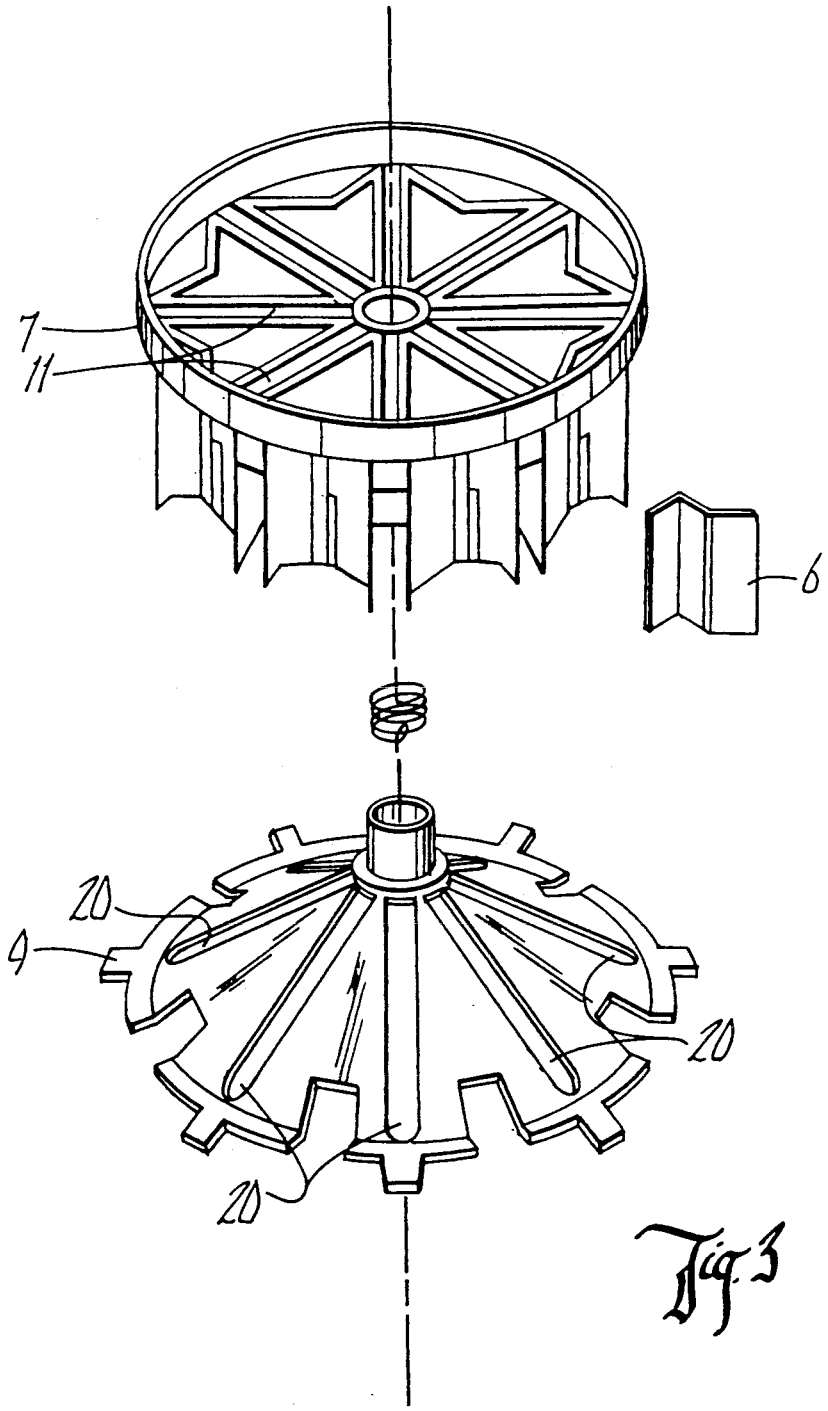
FIG. 3 is an exploded perspective view of the cylindrical body and corresponding conical body of the invention, as described below.

In view of the commented figures, and in accordance with the numbering used, we can observe how in the inside of the housing 1 of the telephone apparatus, a conventional coin value selector 2 is located. A cylindrical body 7 which acts as a provisional receptacle of the evaluated coins is located below the selector 2.

The cylindrical body 7 is provided with a series of radial compartments 11 which are progressively rotated by motor 3 to position compartments 11 under the outlet of the selector 2 for receipt of coins 12 in a vertical position. The provisional receptacle 7 is activated by the motor 3 to effect the turn, and the different compartments 11 remain under the outlet of the coins evaluated by the selector 2.

The compartments 11 have their bottom base open. The open base is normally blocked by the conical body 9 having slots or openings 20 therein. Upon a slight turning of the body 9, actuated by a motor or coil (not shown), the coins remaining in compartments 11 fall to the return box 8. The body 7 is provided with a single side payment door 6, which upon actuation of the coil 5, will open thereby permitting the release of the coin 12 located in the adjacent compartment. The body 9 has its compartment closing elements inclined outwardly to allow the release of the coins through the slots therein or through door 6. A coil 10 controls the passage of coins to the deposit and informs that payment has been made.

When the user is going to use the telephone, he will insert a series of coins which once they have been evaluated by the conventional selector 2, will be dropped into the compartments 11. When the cost of the call coincides with the coin with the highest value, the motor 3 will make the receptacle 7 turn so that the compartment 11 which contains said coin will face the opening coil 5 of the payment door 6, the coin falling to the moneybox 4, the coil ordering said payment.

Thus, the user will continue speaking and the payment device will be activated in the indicated manner as long as the user continues to speak and the cost of the call reaches the amount of the coin of the largest value located in any one of the compartments 11.

When the call is cut off or the user finishes by hanging up the receiver, the payment will be made in the most exact possible form, in accordance with the coins existing in the compartments 11, either by collecting a single coin, or else by means of the combination of different coins whose amount comes closest to the cost of the call.

Once the call has been paid for, a small turning of the body 9 will take place in order to produce the discharge of the coins which have not been used, which are still located in the compartments 11, so that they fall into the return box 8.

When a coin is introduced into the telephone, selector 2 evaluates the various coins which move to the different compartments 11 of body 7. The position of each coin is thereby known at each moment. Thus, motor 3 will cause the adequate turn or turns of body 7 so that the adequate compartment or compartments is/are positioned in front of the coil 5 to be activated, so that the corresponding coin may fall down. Thereby, when the amount to be charged corresponds exactly (or by approximation, to the nearest lower value) to the value of one single coin contained in the compartments 11 of the body 7, said compartment 11 will be positioned in front of coil 5 which, when activated, allows the outlet of the coin.

When the amount to be charged corresponds for example to the value of three coins or to the nearest lower value thereof, motor 3 will provoke three movements whereby each movement leads one coin to the coil 5 which is then consecutively activated three times and then allows the outlet of each of the coins.

For returning the unrequired coins one single movement of body 9 will suffice to position its slots 20 with the opened compartments 11 so that all the coins to be returned fall out simultaneously.

The turn movement of body 7 for charging is simultaneous with that of body 9 whilst for returning the coins a slight turn of body 9 in the direction contrary to the positioning direction will suffice.

What is claimed is:

1. A telephone payment device for use in a coin-operated telephone wherein the user inserts a series of coins of an identical or different value to pay for the telephone call, the telephone having a coin value selector with a coin outlet, a coin return box, and a coin collection box, the device comprising:

a provisional coin receptacle made up of a cylindrical body provided with a series of radial compartments able to position themselves successively under the coin outlet of the coin value selector for the depositing of a coin from the selector into a compartment, said compartments being open at the bottom;

a conical body mounted below the cylindrical body so as to normally block the open bottom of the cylindrical body to prevent coins from passing therethrough, said conical body having an inclination towards the perimeter with a plurality of slots in the conical body, whereby, upon rotating the conical body slightly with respect to the cylindrical body, the slots align with the open bottom of the cylindrical body so as to allow coins contained in the compartments to pass to the return box; and a payment door laterally adjacent the cylindrical body to allow a coin from a compartment to pass to the collection box.

* * * * *